United States Patent [19]

Derby

[11] 4,179,639

[45] Dec. 18, 1979

[54] ANODE ASSEMBLY FOR ELECTRON DISCHARGE DEVICES

[75] Inventor: Palmer P. Derby, Weston, Mass.

[73] Assignee: Raytheon Company, Lexington, Mass.

[21] Appl. No.: 837,652

[22] Filed: Sep. 28, 1977

Related U.S. Application Data

[60] Division of Ser. No. 724,813, Sep. 20, 1976, which is a continuation of Ser. No. 571,891, Apr. 25, 1975, abandoned.

[51] Int. Cl.[2] ..... H01J 23/22

[52] U.S. Cl. ..... 315/39.69; 315/39.75; 228/115; 29/25.17

[58] Field of Search ..... 315/39.69, 39.75, 39.51; 228/115; 29/25.17, 25.19

[56] References Cited

U.S. PATENT DOCUMENTS

| | | | |
|---|---|---|---|
| 2,624,862 | 1/1953 | Everhart et al. | 315/39.69 |
| 3,058,029 | 10/1962 | Clampitt et al. | 315/39.69 |
| 3,423,632 | 1/1969 | Uchimaru et al. | 315/39.69 |
| 4,056,756 | 11/1977 | Derby | 315/39.69 |

*Primary Examiner*—Saxfield Chatmon, Jr.
*Attorney, Agent, or Firm*—M. D. Bartlett; J. D. Pannone; H. W. Arnold

[57] ABSTRACT

A novel anode structure for electron discharge devices, for example, a crossed field oscillator of the magnetron type is fabricated by uniting nonthermally substantially similar cylindrical members each having a boundary wall member and plurality of vane members. The vane member edges are provided with alternate clearance or contacting mating notches to position an annular strap or straps in the complete anode assembly. Less expensive metal castings, such as aluminum, and other suitable vacuum materials, and such techniques as pressure welding and interference fits may be employed without expensive brazing procedures to result in a simplified less expensive anode structure. Different anode vane configurations are simply implemented, such as V-shapes, utilizing castings or similar structures which when joined together form the composite anode assembly.

5 Claims, 10 Drawing Figures

ANODE ASSEMBLY FOR ELECTRON DISCHARGE DEVICES

This is a division of application Ser. No. 724,813, filed Sept. 20, 1976, which is a continuation of application Ser. No. 571,891, filed Apr. 25, 1975, now abandoned.

BACKGROUND OF THE INVENTION

1. Field of the Invention

The invention relates to the assembly and structure for providing electron discharge tube anode members which utilize castings and electrical contacts made by nonthermal techniques.

2. Description of the Prior Art

A well known microwave energy generator is the crossed field magnetron device incorporating a central cylindrical cathode encircled by a plurality of cavity resonators defined by vane members extending from common boundary wall member of an anode member. An external magnetic field is applied parallel to the axis of the cathode member while an electric field is established transverse between the cathode and anode members to thereby provide crossed electric and magnetic fields. Typically, in such devices electrons are emitted from an electron emissive cathode into an annular interaction space between the cathode and anode members. Under the influence of the crossed electric and magnetic fields a revolving spoke-like space charge provides electronic interaction and oscillations at the very high frequencies.

Commonly the anode member comprises a circumferentially disposed anode cavity resonator system defined by a plurality of anode elements in the form of substantially flat vane members. These vanes are joined at their base portions to a cylindrical common boundary wall member with the free ends extending into the annular interaction region. Single or double conductivemetallic straps are connected to alternate vane members to further enhance the efficiencies of the cavity resonator system. One period of the anode member is bounded by two vane members and is referred to as a cavity resonator. The magnetron oscillator may be operated under pulsed or continuous wave conditions and commonly generate the high frequency oscillations in the so-called "pi-mode" which are then coupled inductively to a loop in one of the cavity resonators of the anode member. Such devices are either tunable or fixed tuned.

The magnetron is the widely used power source for microwave cooking ovens which in recent years have become more widely accepted in home and industrial applications. The magnetrons utilized in the microwave ovens have undergone numerous modifications in the interest of compact packaging, as well as lowering costs in these applications. The component which utilizes the most metal and comprises a substantial percentage of the overall tube package is the anode member defining the circumferentially disposed cavity resonators. Conventionally, these members are fabricated of a high conductivity oxygen-free copper and the radially disposed vanes are assembled by well-known brazing and welding metallurgical techniques. Expensive metals, such as gold and silver, are typically utilized for the brazing alloys. New and novel anode fabrication techniques including the use of other materials will further advance the state of the art particularly in the microwave cooking applications.

For the purposes of the present specification and to assist in an understanding of the invention the term "magnetron" is utilized to denote the entire assembly including the anode and cathode, as well as the external magnets, pole pieces, cooling structures and output coupling means. The term "nonthermally" refers to metallurgical techniques for providing intimate electrical contact between two components without heating, such as welding and brazing, and includes cold welding and interference fits to unite the components.

SUMMARY OF THE INVENTION

In accordance with the teachings of the present invention a magnetron anode member is provided by separate members which are substantially identical and mirror images of one another. A structure comprising the cylindrical common boundary wall member together with a cluster of vane members may be provided by a metal casting of, for example, aluminum. A notch or notches are provided at an intermediate region in each of the vane members' edge walls structured so that adjacent notches will mate and alternately provide for contact or clearance of a single strap member or several concentric members. Substantially similar anode sections are provided having substantially the same vane cluster arrangement so that upon assembly of the two separate sections a composite anode member with alternate strapping arrangement will evolve. In one embodiment a single strap substantially centrally located with respect to the combined overall height of the assembled vane members is provided. The strap member has either a square, rectangular or circular configuration or cross section compatible to some type of a forced fit and the notches match the desired strap cross-sectional configuration. In another embodiment the adjacent mating edges of the vane sections are modified so as to provide a biting knife edge of one vane section into the opposing surface. Still another embodiment of the invention provides for vane configurations such as a substantially V-shape, in lieu of the conventional flat metallic vane. Another embodiment provides for contact by only the conductive strap or straps between two sections with a small gap remaining between the opposing vane walls and an outer cylinder supporting the complete assembly.

During assembly the separate sections of the composite anode assembly are retained in a suitable fixture and hydraulic pressure is applied of a sufficient force to effect a substantially cold metallurgical weld at the adjacent surfaces. A cylindrical outer shell member encompasses the assembled components and with proper dimensioning to provide for force fitting a pressure is extended on the cylindrical wall members to maintain the anode member in its desired position during operation when heating of the anode assembly occurs. Interference fits between the strap members and vanes may also provide adequate contact electrically. After the composite anode assembly has been completed the remainder of the components to provide the overall magnetron are assembled in the conventional manner.

BRIEF DESCRIPTION OF THE DRAWINGS

Details of the invention will be readily understood after consideration of the following description of an illustrative embodiment and reference to the accompanying drawings, wherein.

DESCRIPTION OF THE PREFERRED EMBODIMENT

Figure 1:
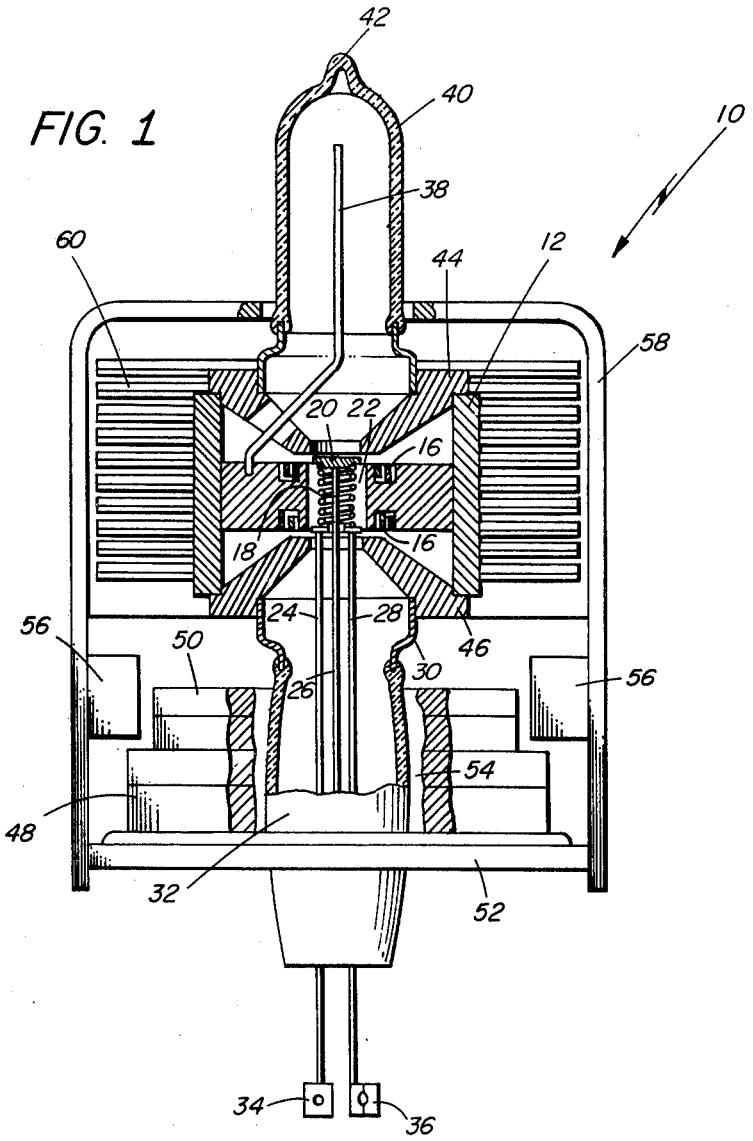
FIG. 1 is a vertical cross-sectional view of a prior art magnetron.
Figure 2:
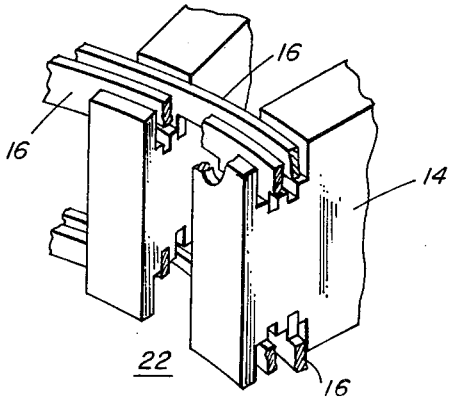
FIG. 2 is a partial isometric view illustrative of prior art magnetron strapping structures.

Before proceeding to the description of the embodiment of the invention, reference is directed to FIGS. 1 and 2 of the drawings. The magnetron generator 10 comprises a cylindrical conductive anode wall member 12 having a plurality of circumferentially disposed cavity resonators defined by vane elements 14. The anode member also provides a portion of the overall envelope of the device. Conductive straps 16 couple alternate vane elements 14 to provide the resonant system in such devices. In this embodiment two conductive straps 16 have been illustrated and these straps are provided adjacent the top and bottom edges of the vane elements in the manner well known in the art. The straps introduce mode separation in the system by increasing the wavelength of the "pi-mode" while affecting other modes to a lesser degree. In the "pi-mode" the midplane of each segment of the anode resonator system is a voltage loop and current flows into the straps that are in parallel with the capacitance of the unstrapped resonator. For the other modes of the system the strap capacitances have a lesser effect and thereby increase the frequency separation between the modes of the anode producing as a result improved mode stability and electrical efficiency.

An axially disposed directly heated cathode 18, which may be of the thoriated tungsten type, is provided with end shields 20. The emitted electrons are directed in a circular orbital path within the interaction region 22 adjacent the free ends of the vane elements 14. The cathode emitter assembly is connected and supported by electrical leads 24 and 26 or 28 extending axially through a support structure including a conductive collar 30 and a dielectric tubular member 32. The central lead 26 is connected to the upper end shield 20 and the outer leads 24 or 28 are connected to the lower end shield 20. Leads 24 and 28 are provided with connectors 34 and 36 for coupling the high DC electrical voltages for operation of the magnetron. In operation the cathode is maintained at a negative potential while the anode member is at ground potential. The electrical leads are coupled to the external voltage supplies through a shielded bypass capacitor filter arrangement which has not been illustrated since such structures are now well known in the art.

The generated microwave energy is coupled from the magnetron by means of a conductive antenna 38 secured to one of the vane elements 14. The antenna extends within a dielectric dome member 40 extending axially from the opposing side of the anode wall member. The magnetron envelope is evacuated by conventional means coupled to the dome member 40 which is tipped off as at 42.

The magnetic field producing means includes conical shaped inner pole piece members 44 and 46 which also enclosed the ends of the anode member to define a vacuum tight envelope. The magnetic field paths are directed parallel to the axis of the cathode 18 within the interaction region. The electric fields extend between the anode member and cathode or transverse to the magnetic field lines to thereby provide the crossed fields. A stack of low cost permanent magnets includes a pair of large rectangular magnets 48 and a pair of smaller rectangular magnets 50 all supported by a return plate member 52. The magnets are provided with axial passageways 54 to accommodate the cathode leads and tubular member 32. For the operation of magnetrons capable of generating approximately 700 to 750 watts of microwave energy, a magnetic field of approximately 1800 gauss will suffice. To shape the magnetic field paths within the magnetron generator interaction space opposing bucking magnets 56 having opposite polar designations are supported by U-shaped magnetic field return path member 58 having a U-shape and engaging the plate member 52.

Cooling fins 60 contact the side walls of the anode member 12 for directing a fluid medium to effectively remove the heat generated by the high frequency oscillations when the tube is operative. This completes the assembly of the magnetron of the type which may be evolved with the embodiment of the present invention.

Figure 3:
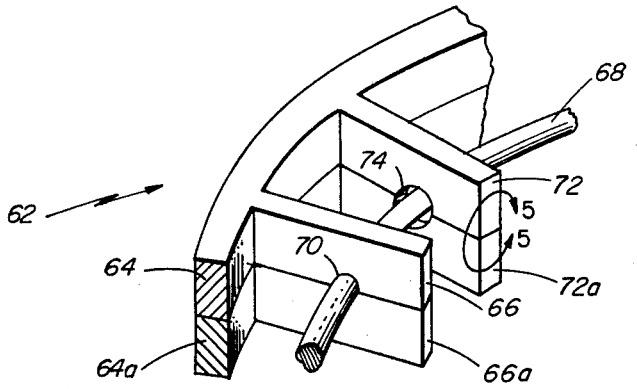
FIG. 3 is a partial isometric view of an assembled magnetron anode in accordance with the present invention.
Figure 4:
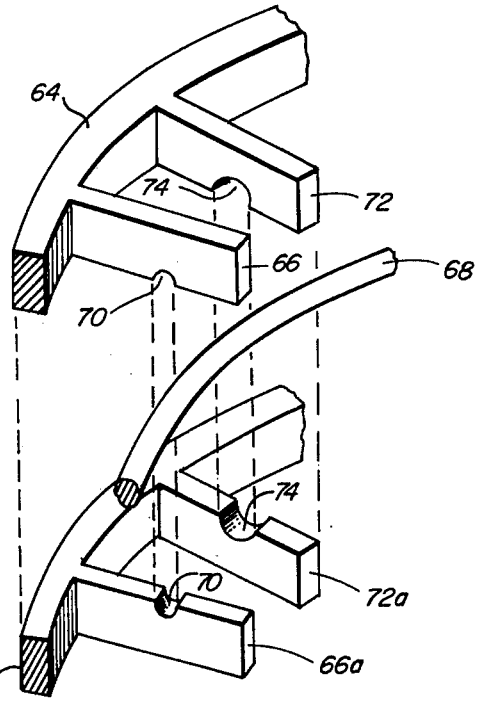
FIG. 4 is an exploded view of the components as illustrated in FIG. 3.

Referring to FIG. 3 the new anode assembly 62 is illustrated. Separate conductive anode members each define a common cylindrical boundary wall member 64 and 64*a*. Vane sections 66 and 66*a* are secured at one end to the wall member and collectively provide a desired overall height of the combined vane member 66, 66*a*. In the illustrated embodiment a single strap system is provided comprising a circular ring strap member 68. It will be noted in FIG. 3, as well as FIG. 4, that vane sections, 66 and 66*a* contact the circular strap 68 by means of notches 70 in adjacent mating edges. Referring particularly to FIG. 4 a notch 70 is provided in the first or upper vane secion 66 and a similar dimensioned notch 70 is provided in the second or lower vane section 66*a*. When the two anode members are superimposed and united by nonthermal metallurgical techniques, such as cold pressure welding, the strap 68 achieves electrical contact with the vane sections.

Referring to adjacent vane member sections 72 and 72*a*, a clearance circular passage is provided. The dimensions of notches 74 are slightly larger than dimensions of the notches 70 in the adjacent sections to define the clearance required. In this manner alternate strapping commonly provided in strapped anodes is provided. It is noted, that in the new anode structure disclosed, a single strap is provided at a midplane location in the axial height provided by the upper and lower edges of the combined vane members.

Figure 5:
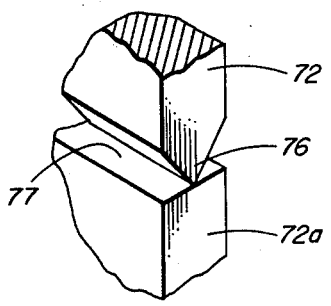
FIG. 5 is a fragmentary isometric view taken along the line 5—5 in the directions of the arrows in FIG. 3.

Referring next to FIG. 5 it will be noted that the mating edges 76 and 76*a* of the vane sections may be readily adapted to facilitate the use of the nonthermal metallurgical techniques. In this embodiment a knife edge 76 is provided for section 72 while the mating surface of the opposing vane section 72 is provided with a flat surface 77. The exertion of a substantial pressure during compression with a hydraulic press, for example, will result in a bonding between the two surfaces without resorting to the use of any brazing alloys and techniques. After the assembly of the upper and lower anode sections the assembly may be further provided with an anode member 78 as shown in FIG. 6 which may be dimensioned to provide a forced fit to hold the anode member at desired distance within the completed magnetron tube.

Figure 6:
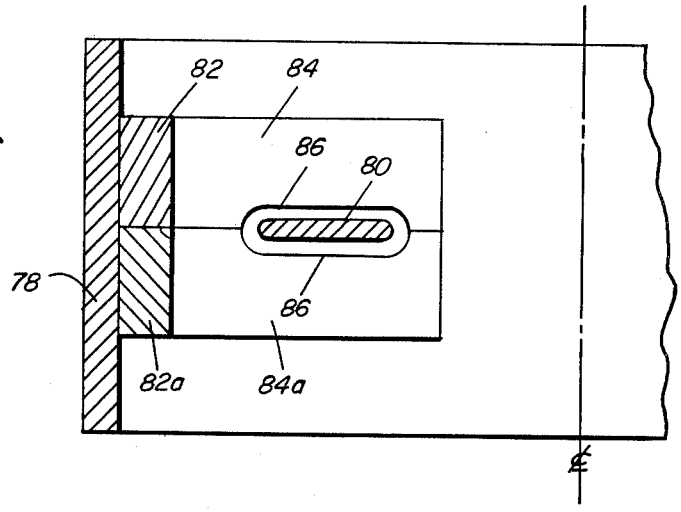
FIG. 6 is a detailed cross-sectional view of a single strap magnetron anode embodying the invention.

In the embodiment, shown in FIG. 6, a substantially rectangular single strap is illustrated and the common wall portions and upper and lower vane sections are designated 82, 82*a*, and 84, 84*a*. In this embodiment the clearance passageways substantially conforming to the contour of the single strap is indicated by the combined notches 86. Again attention is directed to this displacement of the single strap as being centrally disposed at the midplane between the upper and lower or noncontacting edges of the combined vane member. The strap is also disposed at an intermediate point along the mating edges of sections 84 and 84*a*. The individual vane and common boundary wall sections may be cast of such metals as aluminum. A circular body with a plurality of slots in the boundary wall to receive the vane sections could also be utilized.

Figure 7:
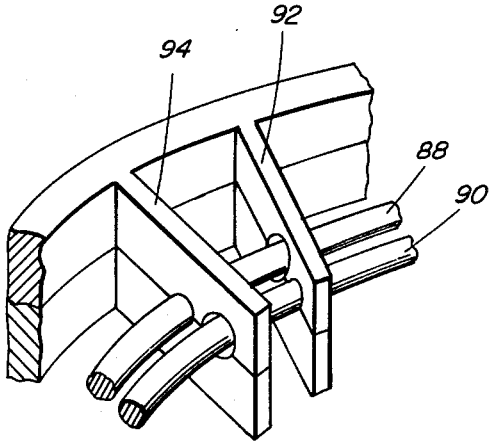
FIG. 7 is a partial isometric view of a double circular strapped magnetron anode illustrative of the invention.
Figure 8:
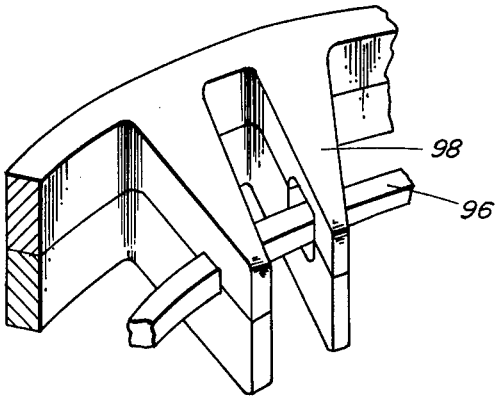
FIG. 8 is a partial isometric view of an alternative vane member configuration.

Referring next to FIG. 7 a double strap arrangement with straps 88 and 90 is shown, again, disposed at the midplane between the upper and lower edges of the combined vane members 92 and 94. In this embodiment the two notches in vane section 92 provide the larger dimension on the left side while the smaller contacting dimension is on the right. In vane 94 the opposite relationship is now noted so that in the final assembly each of the straps is alternately contacting a different vane member. FIG. 8 illustrates two modifications, namely, provision of a square strap member 96 as well as the V-shaped vane member 98 which could be simply provided in a metal casting.

Figure 9:
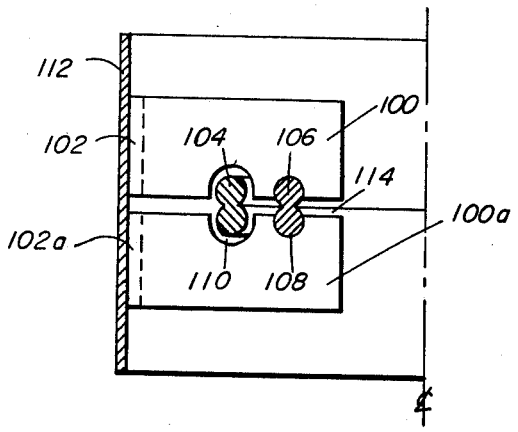
FIG. 9 is a cross-sectional view of an alternative strap configuration with spaced vane member edges.

FIG. 9 illustrates still another modification of the invention with upper and lower vane sections 100 and 100*a* appended to common boundary walls 102 and 102*a* and force fitted within a cylindrical shell member 112. The double strap configuration is illustrated with the concentric straps 104 and 106 having a substantially numeral eight configuration. This configuration will facilitate the forced fit of the dual straps within the contacting notches 108 while the clearance notches are designated as 110. One of the anode vane and boundary wall components is forced with suitable tools and fixtures within a shell member 112. The straps 104 and 106 are dropped in the notches and the upper anode component is forced with the shell by suitable tools. Continued pressure from opposing sides of the assembled components results in the straps snapping into the appropriate notches. In the final assembly a small gap 114 results over the adjacent edges of the assembled vane and boundary wall sections. The spacing of the gap is controlled by the strap dimensions. The gap 114 is believed to assist in preventing unwanted electronic losses adjacent the joining edges of the vane sections which could adversely affect the overall efficiency of the device.

Figure 10:
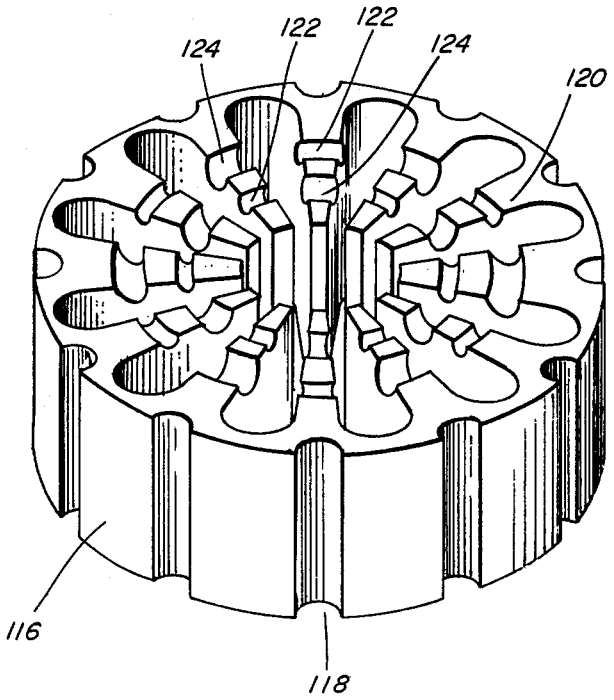
FIG. 10 is an isometric view of an anode member casting embodying the invention.

FIG. 10 illustrates another possible configuration of a casting of one of the anode member sections from a material, such as copper or copper-aluminum alloy, with the outer cylindrical wall portion 116 slotted, as at 118, to substantially reduce the quantity of materials used for the anode member. The vanes 120, having a slight V-shape provide a series of notches 122 and 124 which vary in an alternating manner from anode vane to anode vane. Hence, the notches designated by the numeral 122 having the smaller configuration are on the outside of alternate vane members while the larger notch 124 is on the inside. The next adjacent vane member section, however, has a reverse disposition of the notches with the larger notch 124 on the outside and the smaller notch 122 on the inside.

A method of assembling the components illustrated in FIGS. 9 and 10 comprises force fitting an anode section similar to FIG. 10 within the substantially thin walled anode cylinder 112. A fixture will permit the insertion of the lower anode section within the shell 112 until a desired distance is achieved. The two strap rings may be dropped in their respective grooves followed by a similar upper anode section inserted. A hydraulic press could be utilized to force fit the two anode members to form a united combined anode assembly with the straps snapped into position in the notches. A gap may be provided as shown in FIG. 9 or the sections will abut as shown in FIGS. 3, 6, 7 and 8. After the anode assembly has been fabricated the remaining components hereinbefore described are assembled to complete the magnetron device.

There is thus disclosed a unique arrangement which has evolved a new and novel anode and strap displacement. Numerous variations and modifications will be evident to those skilled in the art. The foregoing description of the illustrative embodiment is, therefore, to be considered in its broadest aspects and not in a limiting sense.

It is claimed that:

1. An anode structure for an electromagnetic energy generator comprising:

a plurality of substantially similar shaped conductive anode member sections;

each of said anode member sections having a cylindrical boundary wall portion and a radially extending vane section joined at one end to said wall portion and having a free end;

at least one annular conductive strap member disposed between said conductive anode member sections and contacting alternative vanes of each of said anode member sections;

said conductive anode member sections being joined to said strap member by non-thermal metallurgical techniques to define an anode member; and said conductive anode member sections being supported within a conductive shell and the adjacent boundary wall portions and vane section edges are spaced apart with contact only therebetween by said strap member.

2. An anode structure for a magnetron generator comprising:

a plurality of substantially conductive anode member sections;

each of said anode member sections having a cylindrical boundary wall portion and a vane extending inwardly from said wall portion to a central bore;

strapping means comprising at least one annular conductive strap member contacting alternate vanes of each conductive member section adjacent said bore;

said conductive anode member sections being supported within a shell and spaced apart by said strapping means; and said strapping means being bonded to said conductive anode member sections by non-thermal metallurgical techniques.

3. An anode for a magnetron generator comprising:

a plurality of substantially conductive anode member sections, each having a cylindrical boundary wall portion formed integrally with a conductive element which extend from said wall portion inwardly to a central bore;

a plurality of annular conductive strap members contacting different alternate conductive elements;

said conductive anode member sections being spaced apart with contact therebetween by said strap members; and said strap members being bonded to said conductive anode member sections by non-thermal metallurgical techniques.

4. A magnetron comprising:

an evacuated element containing a plurality of substantially similarly shaped conductive anode member sections;

each of said conductive anode member sections having a cylindrical boundary wall portion and a conductive vane extending inwardly from said boundary wall portion to a central bore containing a cathode spaced from the ends of said vanes;

said anode member sections being separated by at least one conductive strap member bonded to alternate conductive vanes of each anode member by non-thermal metallurgical techniques; and said anode member sections being spaced apart by said strap member.

5. The magnetron in accordance with claim 4 wherein:

said strap contacts said anode member sections in notches in said vanes.

* * * * *